US005507620A

United States Patent [19]

Primoschitz et al.

[11] Patent Number: 5,507,620

[45] Date of Patent: Apr. 16, 1996

[54] GAS TURBINE WITH COOLED ROTOR

[75] Inventors: Eduard Primoschitz, Stetten; Pavel Rihak, Baden, both of Switzerland

[73] Assignee: ABB Management AG, Baden, Switzerland

[21] Appl. No.: 274,702

[22] Filed: Jul. 14, 1994

[30] Foreign Application Priority Data

Jul. 17, 1993 [DE] Germany ..... 43 24 034.8

[51] Int. Cl.[6] ..... F01D 5/08

[52] U.S. Cl. ..... 416/96 R; 416/97 R; 416/198 A

[58] Field of Search ..... 416/96 R, 97 R, 416/198 A, 201 R, 213 R; 415/115, 116

[56] References Cited

U.S. PATENT DOCUMENTS

| | | | |
|---|---|---|---|
| 2,656,147 | 10/1953 | Brownhill et al. | 416/97 R |
| 2,810,544 | 10/1957 | Schorner | 416/96 R |
| 2,858,103 | 10/1958 | Waugh | 416/97 R |
| 3,742,706 | 7/1973 | Klompas | 416/97 R |
| 3,751,909 | 8/1973 | Kohler | 415/115 |
| 4,447,188 | 5/1984 | Davis et al. | 416/97 R |

FOREIGN PATENT DOCUMENTS 971297 1/1959 Germany .

*Primary Examiner*—Edward K. Look
*Assistant Examiner*—James A. Larson
*Attorney, Agent, or Firm*—Oblon, Spivak, McClelland, Maier & Neustadt

[57] ABSTRACT

The gas turbine has a bladed rotor welded together from a plurality of disks. Hollow spaces are present between the disks and axial passages are present in the periphery of the rotor between the rotor surface and platforms formed by the rotor blades and segmental heat barrier plates. In accordance with the invention, these axial passages are fed with cooling air from at least one hollow space between two rotor disks. The at least one hollow space is in connection with the axial passages mentioned, preferably by of connecting openings. It is fed from a central cooling air supply passage starting from the downstream end of the rotor. The cooling air is preferably tapped from the cycle air at the central part of the compressor so that low-pressure cooling occurs.

2 Claims, 2 Drawing Sheets

GAS TURBINE WITH COOLED ROTOR

BACKGROUND OF THE INVENTION

1. Field of the Invention

The present invention relates to a single-shaft stationary gas turbine for electricity generation, having a bladed rotor welded together from a plurality of disks, hollow spaces being present between the disks and axial passages fed with cooling air being present in the periphery of the rotor between the rotor surface and platforms formed by the rotor blades and segmental heat barrier plates.

2. Discussion of Background

Gas turbines of this type are known, the cooling air being taken from the high-pressure part of the compressor in the known gas turbines.

SUMMARY OF THE INVENTION

Accordingly, one object of the invention is to provide novel improved rotor cooling in a gas turbine of the type mentioned at the beginning. In accordance with the invention, this takes place by feeding the axial passages in the periphery of the rotor from the hollow spaces between the rotor disks. The hollow spaces are then preferably in connection with the axial passages mentioned by means of connecting openings and are fed by means of a central cooling air supply passage which starts from the downstream end of the rotor.

An important advantage of the invention may be seen in the fact that the cooling air can be taken from the central part of the compressor where it still has a lower pressure and a lower temperature than that at the outlet from the compressor. Compared with the known high-pressure cooling, the low-pressure cooling occurring in this case is more effective and also involves a smaller cooling air flow. The losses are also lower and the efficiency is therefore improved.

Further preferred embodiments are claimed in the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
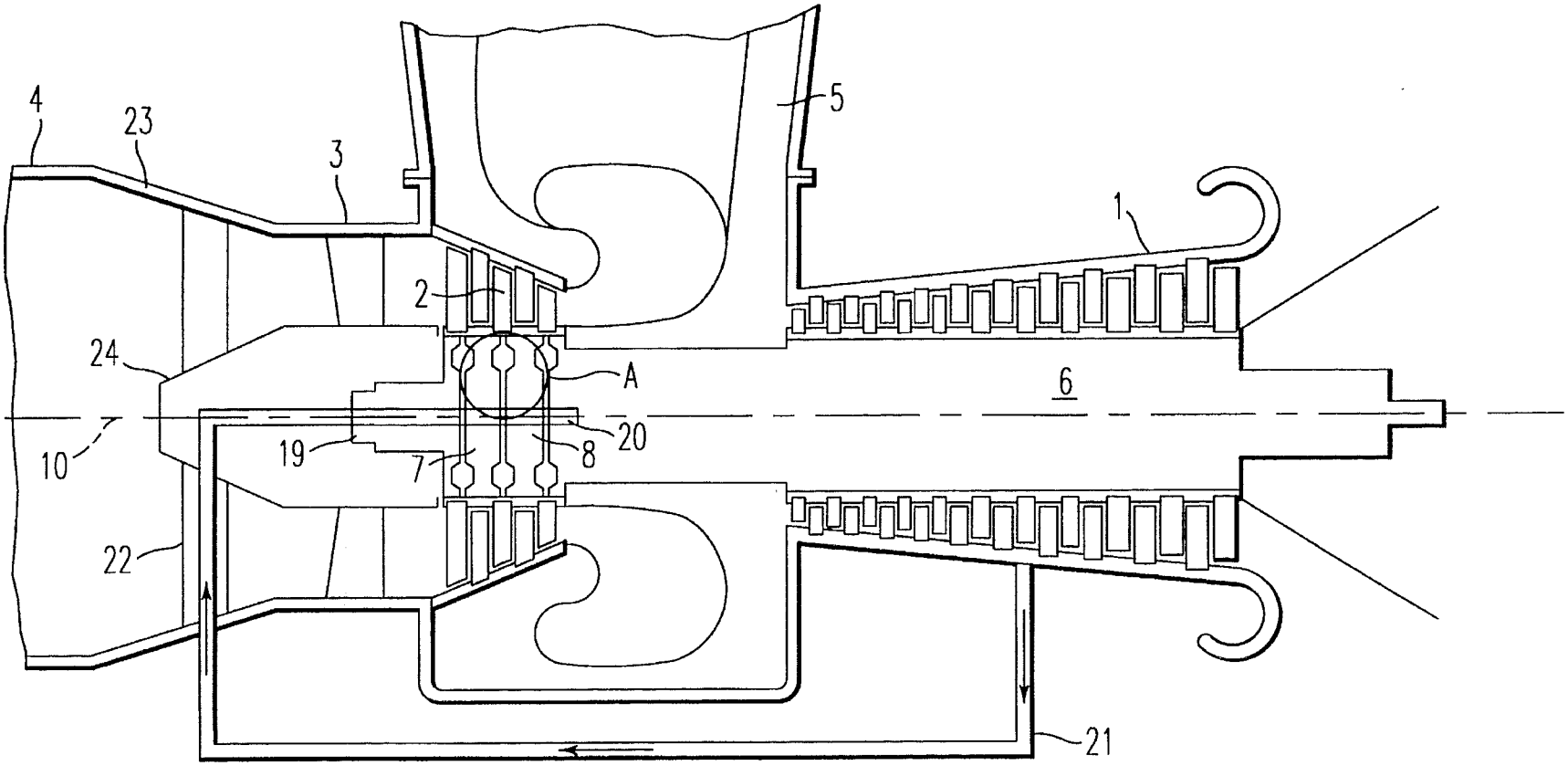
FIG. 1 shows, diagrammatically, a gas turbine according to the invention

Referring now to the drawings, wherein like reference numerals designate identical or corresponding parts throughout the several views, the gas turbine shown in FIG. 1 has a compressor 1, a turbine 2, an exhaust gas casing 3 and an exhaust gas diffuser 4. The combustion chamber is designated by 5 and the rotor is designated by 6. The rotor 6 is welded together from a plurality of disks in its axial direction, hollow spaces respectively remaining between the individual disks. Two disks are shown in FIG. 1 and are designated by 7 and 8. The structure of the hollow spaces between the rotor disks can be recognized from the magnified excerpt in FIG. 2. The hollow space shown there, between the rotor disks 7 and 8, is designated by 9. It is narrow in its central region around the rotor center line 10 and it widens outwards to form a sort of annular chamber 11. The annular, fully peripheral weld seam between the adjacent rotor disks 7 and 8 is designated by 12. Some rotor blades 13 and guide vanes 14 of the turbine 1 are shown in a purely diagrammatic manner in the upper part of FIG. 2. An axial passage 17, which is subdivided by a seal 26 into a high-pressure section 17HD and a low-pressure section 17ND, is present between the actual rotor surface 15 and platforms 16, likewise only shown in a purely diagrammatic manner and formed by the rotor blades and by segmental heat barrier plates. The hollow spaces 9 between the rotor disks are in connection with the axial passage by means of a number of connecting openings or holes 18 respectively distributed over the periphery.

As may be recognized better from FIG. 1, the rotor 6 is provided, along its center line 10, with a central passage 20 starting from the end surface 19 of its downstream end. The axial passage 17 in the periphery of the rotor is fed with cooling air through the central passage 20, the hollow spaces 9 and the connecting openings 18.

The cooling air is branched off in the central part of the compressor from the cycle air which has already been partially compressed there and is led via a conduit 21 to the end surface 19 of the downstream end of the rotor. The conduit 21 passes through hollow ribs 22 between the outer ring 23 and the inner ring 24 of the exhaust gas diffuser and casing 3, 4.

Reference is now made to FIG. 2 again. It may there be recognized that the connecting openings 18 commence right at the outside of the hollow spaces 9, i.e. where the latter have their largest diameter and radial distance R1. Each of the annular chambers 11 of the hollow spaces 9 becomes continuously narrower beyond the radius R2 toward the distance R1 and, therefore, toward the connecting openings. This ensures that dirt entrained in the cooling air cannot collect in the hollow spaces 9 but is centrifuged outwards through the connecting openings 18. This avoids unbalance of the rotor caused by collections of dirt and also avoids thermal insulation effects due to dirt deposits.

In the present embodiment example, the weld seam 12 is arranged somewhat offset axially relative to the connecting openings 18. The weld bottom 25 therefore comes to be located at a radial distance R3 from the rotor center line 10. This distance is somewhat smaller than the radial distance R1 at which the connecting openings 18 start. The previously usual formation of pockets on both sides of the weld seam 12 at the outer zone of the hollow spaces 9, in order to unload the weld bottom 25, is dispensed with for the reasons previously mentioned of centrifuging out the dirt.

Figure 2:
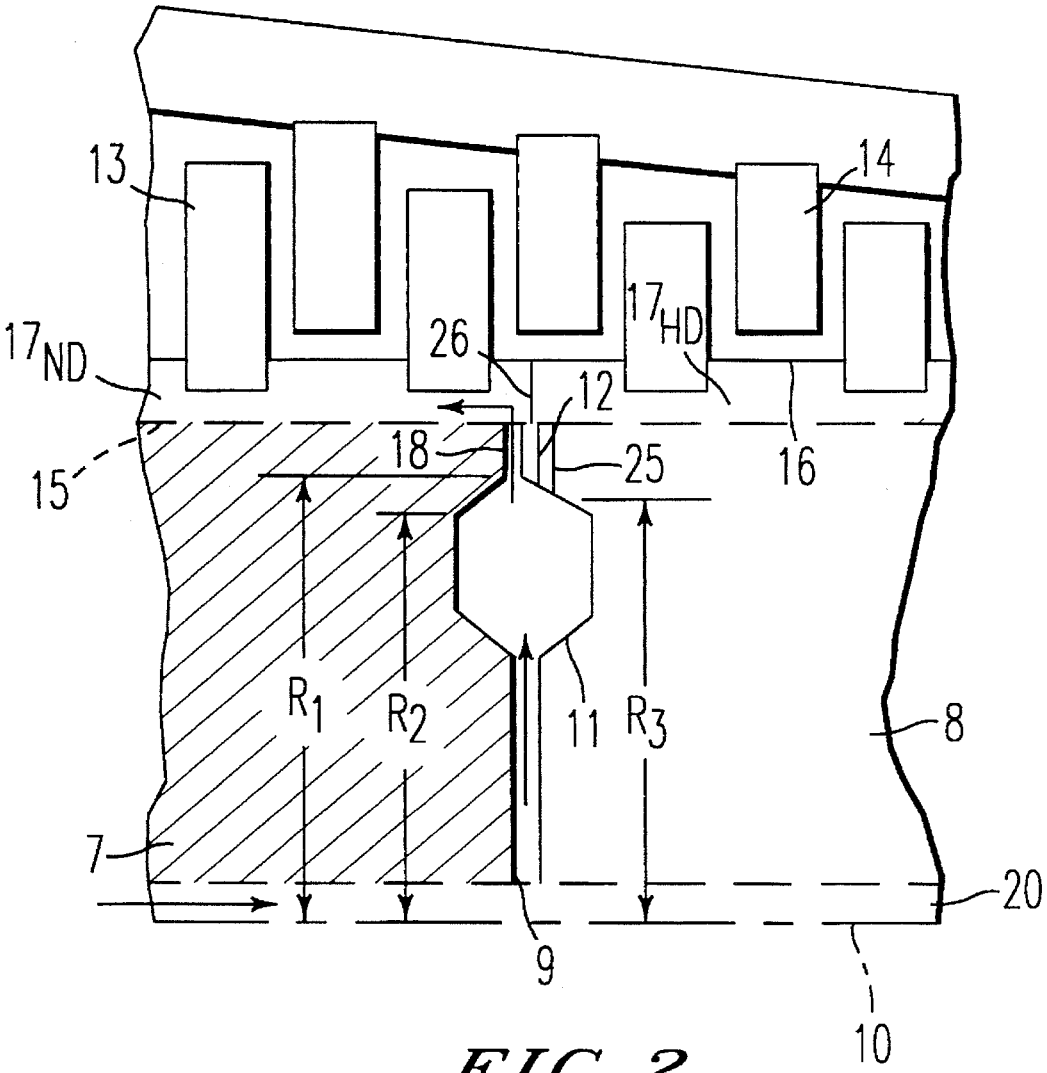
FIG. 2 shows an enlargement of an excerpt (circle A) of FIG. 1.

As a departure from the representation of FIG. 2, which is not to scale, it is advantageous to make each weld seam 12 thicker than the minimum mutual distance between the rotor disks. Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A single-shaft stationary gas turbine for electricity generation, having a rotor welded together from a plurality of disks having edge zones, said rotor having a surface and a center line and being provided with rotor blades, hollow spaces being present between the disk and axial passages being present in the periphery of the rotor between the rotor surface and platforms formed by the rotor blades and segmental heat barrier plates, whereby a cooling air feed is provided to these axial passages from at least one of the hollow spaces between the rotor disks, wherein one or a plurality of hollow spaces between the rotor disks is in connection with the axial passages of the rotor by means of connecting openings and wherein a central cooling air supply passage is provided along the center line of the rotor, wherein the connecting openings start where the hollow space has its maximum radial distance from the rotor center line, wherein the individual rotor disks are respectively welded together at their edge zones by means of a weld seam having a weld bottom extending as an annulus, wherein each weld seam is arranged offset axially relative to the connecting openings, and wherein the radial distance, from the rotor center line, at which the connecting openings start is larger than the radial distance at which the weld bottom is arranged.

2. The gas turbine as claimed in claim 1, wherein the spaces between the rotor disks become continually narrower toward the connecting openings at least beyond a certain radial distance from the rotor center line.

* * * * *